US008026882B2

(12) United States Patent
Tomiyoshi

(10) Patent No.: US 8,026,882 B2
(45) Date of Patent: Sep. 27, 2011

(54) DISPLAY, DRIVE CIRCUIT OF DISPLAY, AND METHOD OF DRIVING DISPLAY

(75) Inventor: Akira Tomiyoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 846 days.

(21) Appl. No.: 11/988,228

(22) PCT Filed: Jul. 5, 2006

(86) PCT No.: PCT/JP2006/313372

§ 371 (c)(1),
(2), (4) Date: Jan. 3, 2008

(87) PCT Pub. No.: WO2007/052384

PCT Pub. Date: May 10, 2007

(65) Prior Publication Data

US 2009/0141012 A1 Jun. 4, 2009

(30) Foreign Application Priority Data

Nov. 4, 2005 (JP) ..... 2005-320450

(51) Int. Cl.
*G09G 3/36* (2006.01)

(52) U.S. Cl. ..... 345/87; 345/98; 345/100

(58) Field of Classification Search ..... 345/87–100, 345/204

See application file for complete search history.

(56) References Cited

U.S. PATENT DOCUMENTS

| | | | | |
|---|---|---|---|---|
| 7,609,329 | B2 * | 10/2009 | Baek et al. | 348/790 |
| 2003/0107541 | A1 * | 6/2003 | Naiki | 345/87 |
| 2005/0179633 | A1 * | 8/2005 | Inada | 345/98 |

FOREIGN PATENT DOCUMENTS

| | | |
|---|---|---|
| JP | 03-62094 | 3/1991 |
| JP | 08-123359 | 5/1996 |
| JP | 11-003067 | 1/1999 |
| JP | 2003-173173 | 6/2003 |
| JP | 2005-338727 | 12/2005 |

* cited by examiner

*Primary Examiner* — Alexander Eisen
*Assistant Examiner* — Viet Pham
(74) *Attorney, Agent, or Firm* — Harness, Dickey & Pierce, P.L.C.

(57) ABSTRACT

The present invention relates to a display that uses a polysilicon liquid crystal panel.

An object of the present invention is to sufficiently secure a hold period and a setup period upon a rise of a source start pulse signal (SSP) without increasing power consumption or increasing circuit scale.

A display control circuit (200) includes a source start pulse signal generating circuit (2311) that generates a source start pulse signal (SSP); and a source shift clock signal generating circuit (2313) that generates a source shift clock signal (SCK). The source shift clock signal generating circuit (2313) shortens a period during which the source shift clock signal (SCK) is maintained at a high level, only during a period of time which is immediately before the source start pulse signal (SSP) rises in each horizontal scanning period, based on a source shift clock modification command signal (K) to be outputted from the source start pulse signal generating circuit (2311).

15 Claims, 7 Drawing Sheets

DISPLAY, DRIVE CIRCUIT OF DISPLAY, AND METHOD OF DRIVING DISPLAY

TECHNICAL FIELD

The present invention relates to a display, a drive circuit of the display, and a method of driving the display, and more particularly to a display that uses a polysilicon liquid crystal panel such as a CG silicon liquid crystal panel, a drive circuit of the display, and a method of driving the display.

BACKGROUND ART

In recent years, a liquid crystal display that adopts a CG (Continuous Grain) silicon liquid crystal panel has been developed. The CG silicon liquid crystal panel refers to a liquid crystal panel that adopts TFTs (Thin Film Transistors) formed of a CG silicon film, as switching elements. In the CG silicon, grain boundaries are arranged regularly, and the CG silicon has a continuous structure at atomic-level. Therefore, in the CG silicon, electrons can move at high speed and thus a driving integrated circuit can be mounted on a substrate of a liquid crystal panel. By this, a reduction in cost and miniaturization of a device due to a reduction in the number of necessary components are advanced. Note that in the following a liquid crystal display that adopts a CG silicon liquid crystal panel is referred to as a "CG silicon liquid crystal display".

FIG. 2 is a block diagram showing the overall configuration of a CG silicon liquid crystal display. The liquid crystal display has a liquid crystal panel 100 including a source driver (video signal line drive circuit) 300, a gate driver (scanning signal line drive circuit) 400, a display unit 500, and a charge pump circuit 600; and a display control circuit 200. The display unit 500 includes a plurality of (n) source bus lines (video signal lines) SL1 to SLn; a plurality of (m) gate bus lines (scanning signal lines) GL1 to GLm; and a plurality of (n×m) pixel formation portions respectively provided at intersections of the plurality of source bus lines SL1 to SLn and the plurality of gate bus lines GL1 to GLm.

The display control circuit 200 outputs an analog video signal AV, and a source start pulse signal SSP, a source shift clock signal SCK, a gate start pulse signal GSP, and a gate shift clock signal GCK, for controlling timing to display an image on the display unit 500, based on an image signal DAT, a horizontal synchronizing signal Hsync, and a vertical synchronizing signal Vsync which are provided from an external source and a clock signal (hereinafter, referred to as a "source clock signal") CK generated by a clock generator.

The source driver 300 receives the analog video signal AV, the source start pulse signal SSP, and the source shift clock signal SCK which are outputted from the display control circuit 200 and applies a driving video signal to each of the source bus lines SL1 to SLn to display an image on the display unit 500. Here, in the source driver 300, in each horizontal scanning period, taking in of the source start pulse signal SSP is started upon the first rise of the source shift clock signal SCK after the source start pulse signal SSP rises. In conventional common liquid crystal displays, in order that taking in of a source start pulse signal SSP in the source driver 300 can be normally started, as shown in FIG. 5, a hold period is provided before the source start pulse signal SSP rises and a setup period is provided after the source start pulse signal SSP rises. Note that the hold period as used in the description refers to a period provided between the point in time when the source shift clock signal SCK falls and the point in time when the source start pulse signal SSP rises, so as to ensure that the source start pulse signal SSP rises after the source shift clock signal SCK falls. The setup period refers to a period provided between the point in time when the source start pulse signal SSP rises and the point in time when the source shift clock signal SCK rises, so that the logic level of the source start pulse signal SSP is certainly a high level at the point in time when the source shift clock signal SCK rises.

However, in the case of a CG silicon liquid crystal display, since in the liquid crystal panel 100 the delay of the source start pulse signal SSP is sufficiently larger than that of the source shift clock signal SCK, in the display control circuit 200, as shown in FIG. 6, even when a source shift clock signal SCK and a source start pulse signal SSP are generated without setting a hold period, taking in of the source start pulse signal SSP is properly performed in the source driver 300.

In recent years, a reduction in the frame area of such a CG silicon liquid crystal display has been carried out. Hence, when a source shift clock signal SCK and a source start pulse signal SSP are generated without setting a hold period in the above-described manner, the delay of the source start pulse signal SSP relative to the source shift clock signal SCK may not be sufficiently large and thus trouble may occur in image display. Consequently, there is a need to set a hold period when a source shift clock signal SCK and a source start pulse signal SSP are generated in the display control circuit 200.

An example is provided. There is a liquid crystal display in which the cycle of a source clock signal CK is set to T, the cycle of a source shift clock signal SCK is set to 3 T, and a hold period Th and a setup period Ts should respectively satisfy the following equations (1) and (2). Note that FIG. 7 is a signal waveform diagram for such a liquid crystal display.

$$0.5\,T \leqq Th < T \quad (1)$$

$$2\,T < Ts \leqq 2.5\,T \quad (2)$$

According to the aforementioned example, the hold period Th and the setup period Ts are not an integral multiple of the cycle T of the source clock signal CK. Conventionally, in such a case, the frequency of the source clock signal CK is increased or both-edge drive of a clock is performed.

[Patent Document 1] Japanese Patent Application Laid-Open No. 2003-173173

DISCLOSURE OF THE INVENTION

Problems to be Solved by the Invention

However, when the frequency of the source clock signal CK is increased, power consumption increases. When both-edge drive of a clock is performed, due to adoption of a two-phase clock, or the like, circuit scale increases, complicating design.

Means for Solving the Problem

In view of this, an object of the present invention is therefore to sufficiently secure a hold period and a setup period upon a rise of a source start pulse signal SSP in a display that uses a polysilicon liquid crystal panel, such as a CG silicon liquid crystal display, without increasing power consumption or increasing circuit scale.

According to a first aspect of the present invention, a drive circuit for a display that applies a driving video signal to a plurality of video signal lines arranged in a display unit and thereby displays an image on the display unit, the drive circuit including: a display control circuit that outputs a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line drive circuit that receives the video signal, the source start pulse signal, and the source shift clock signal which are outputted from the display control circuit, samples the video signal based on a pulse of the source shift clock signal after a pulse of the source start pulse signal is outputted in each horizontal scanning period, and applies a voltage based on the sampled video signal to the plurality of video signal lines as the driving video signal, wherein the display control circuit makes a width of a pulse of the source shift clock signal, which is outputted immediately before a pulse of the source start pulse signal is outputted, smaller than the first width.

According to a second aspect of the present invention, in the first aspect of the present invention, the display control circuit makes the width of a pulse of the source shift clock signal, which is outputted immediately before a pulse of the source start pulse signal is outputted, smaller than the first width by changing a duty ratio of the source shift clock signal.

According to a third aspect of the present invention, in the first aspect of the present invention, the display control circuit includes: a source start pulse signal generating circuit that generates the source start pulse signal based on the source clock signal; and a source shift clock signal generating circuit that generates the source shift clock signal based on the source clock signal, wherein the source start pulse signal generating circuit generates a source shift clock modification command signal for making the width of a pulse of the source shift clock signal, which is outputted immediately before a pulse of the source start pulse signal is outputted, smaller than the first width, and provides the source shift clock modification command signal to the source shift clock signal generating circuit, and wherein the source shift clock signal generating circuit makes the width of a pulse of the source shift clock signal, which is outputted immediately before a pulse of the source start pulse signal is outputted, smaller than the first width based on the source shift clock modification command signal.

According to a fourth aspect of the present invention, a drive circuit for a display that applies a driving video signal to a plurality of video signal lines arranged in a display unit and thereby displays an image on the display unit, the drive circuit including: a display control circuit that outputs a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line drive circuit that receives the video signal, the source start pulse signal, and the source shift clock signal which are outputted from the display control circuit, samples the video signal based on a pulse of the source shift clock signal after a pulse of the source start pulse signal is outputted in each horizontal scanning period, and applies a voltage based on the sampled video signal to the plurality of video signal lines as the driving video signal, wherein the display control circuit stops an output of a pulse of the source shift clock signal to be outputted immediately before a pulse of the source start pulse signal is outputted.

According to a fifth aspect of the present invention, in the fourth aspect of the present invention, the display control circuit includes: a source start pulse signal generating circuit that generates the source start pulse signal based on the source clock signal; and a source shift clock signal generating circuit that generates the source shift clock signal based on the source clock signal, wherein the source start pulse signal generating circuit generates a source shift clock modification command signal for stopping the output of a pulse of the source shift clock signal to be outputted immediately before a pulse of the source start pulse signal is outputted, and provides the source shift clock modification command signal to the source shift clock signal generating circuit, and wherein the source shift clock signal generating circuit stops the output of a pulse of the source shift clock signal to be outputted immediately before a pulse of the source start pulse signal is outputted, based on the source shift clock modification command signal.

According to a sixth aspect of the present invention, a display that applies a driving video signal to a plurality of video signal lines arranged in a display unit and thereby displays an image on the display unit, the display including: a display control circuit that outputs a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line drive circuit that receives the video signal, the source start pulse signal, and the source shift clock signal which are outputted from the display control circuit, samples the video signal based on a pulse of the source shift clock signal after a pulse of the source start pulse signal is outputted in each horizontal scanning period, and applies a voltage based on the sampled video signal to the plurality of video signal lines as the driving video signal, wherein the display control circuit makes a width of a pulse of the source shift clock signal, which is outputted immediately before a pulse of the source start pulse signal is outputted, smaller than the first width.

According to a seventh aspect of the present invention, in the sixth aspect of the present invention, the display control circuit makes the width of a pulse of the source shift clock signal, which is outputted immediately before a pulse of the source start pulse signal is outputted, smaller than the first width by changing a duty ratio of the source shift clock signal.

According to an eighth aspect of the present invention, in the sixth aspect of the present invention, the display control circuit includes: a source start pulse signal generating circuit that generates the source start pulse signal based on the source clock signal; and a source shift clock signal generating circuit that generates the source shift clock signal based on the source clock signal, wherein the source start pulse signal generating circuit generates a source shift clock modification command signal for making the width of a pulse of the source shift clock signal, which is outputted immediately before a pulse of the source start pulse signal is outputted, smaller than the first width, and provides the source shift clock modification command signal to the source shift clock signal generating circuit, and wherein the source shift clock signal generating circuit makes the width of a pulse of the source shift clock signal, which is outputted immediately before a pulse of the source start pulse signal is outputted, smaller than the first width based on the source shift clock modification command signal.

According to a ninth aspect of the present invention, in the sixth aspect of the present invention, a drive circuit including at least the video signal line drive circuit is made of a polysilicon thin film transistor.

According to a tenth aspect of the present invention, a display that applies a driving video signal to a plurality of video signal lines arranged in a display unit and thereby displays an image on the display unit, the display including: a display control circuit that outputs a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line drive circuit that receives the video signal, the source start pulse signal, and the source shift clock signal which are outputted from the display control circuit, samples the video signal based on a pulse of the source shift clock signal after a pulse of the source start pulse signal is outputted in each horizontal scanning period, and applies a voltage based on the sampled video signal to the plurality of video signal lines as the driving video signal, wherein the display control circuit stops an output of a pulse of the source shift clock signal to be outputted immediately before a pulse of the source start pulse signal is outputted.

According to an eleventh aspect of the present invention, in the tenth aspect of the present invention, the display control circuit includes: a source start pulse signal generating circuit that generates the source start pulse signal based on the source clock signal; and a source shift clock signal generating circuit that generates the source shift clock signal based on the source clock signal, wherein the source start pulse signal generating circuit generates a source shift clock modification command signal for stopping the output of a pulse of the source shift clock signal to be outputted immediately before a pulse of the source start pulse signal is outputted, and provides the source shift clock modification command signal to the source shift clock signal generating circuit, and wherein the source shift clock signal generating circuit stops the output of a pulse of the source shift clock signal to be outputted immediately before a pulse of the source start pulse signal is outputted, based on the source shift clock modification command signal.

According to a twentieth aspect of the present invention, in the tenth aspect of the present invention, a drive circuit including at least the video signal line drive circuit is made of a polysilicon thin film transistor.

According to the thirteenth aspect of the present invention, a drive method for a display that applies a driving video signal to a plurality of video signal lines arranged in a display unit and thereby displays an image on the display unit, the drive method including the steps of: a display controlling step of outputting a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line driving step of receiving the video signal, the source start pulse signal, and the source shift clock signal which are outputted in the display controlling step, sampling the video signal based on a pulse of the source shift clock signal after a pulse of the source start pulse signal is outputted in each horizontal scanning period, and applying a voltage based on the sampled video signal to the plurality of video signal lines as the driving video signal, wherein in the display controlling step, a width of a pulse of the source shift clock signal, which is outputted immediately before a pulse of the source start pulse signal is outputted, is made smaller than the first width.

According to a fourteenth aspect of the present invention, in the thirteenth aspect of the present invention, in the display controlling step, the width of a pulse of the source shift clock signal, which is outputted immediately before a pulse of the source start pulse signal is outputted, is made smaller than the first width by changing a duty ratio of the source shift clock signal.

According to a fifteenth aspect of the present invention, a drive method for a display that applies a driving video signal to a plurality of video signal lines arranged in a display unit and thereby displays an image on the display unit, the drive method including the steps of: a display controlling step of outputting a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line driving step of receiving the video signal, the source start pulse signal, and the source shift clock signal which are outputted in the display controlling step, sampling the video signal based on a pulse of the source shift clock signal after a pulse of the source start pulse signal is outputted in each horizontal scanning period, and applying a voltage based on the sampled video signal to the plurality of video signal lines as the driving video signal, wherein in the display controlling step, an output of a pulse of the source shift clock signal to be outputted immediately before a pulse of the source start pulse signal is outputted is stopped.

Effect of the Invention

According to the first aspect of the present invention, a pulse width of a source shift clock signal to be outputted from the display control circuit is made smaller during a period of time which is immediately before a pulse of a source start pulse signal is outputted. By this, a hold period that is not sufficiently secured in conventional cases is sufficiently secured immediately before the source start pulse signal rises. Hence, without increasing the frequency of a source clock signal or increasing circuit scale, in the video signal line drive circuit, sampling of a video signal can be normally started in each horizontal scanning period. By this, when there is a change in the design of a panel of a display, or the like, a further reduction in power consumption or further simplification of circuit design over conventional cases is made possible.

According to the second aspect of the present invention, during a period of time which is immediately before a pulse of a source start pulse signal is outputted, by changing a duty ratio of a source shift clock signal to be outputted from the display control circuit, a pulse width of the source shift clock signal is made smaller. By this, a hold period that is not sufficiently secured in conventional cases is sufficiently secured immediately before the source start pulse signal rises and a setup period is secured immediately after the source start pulse signal rises. Accordingly, in the video signal line drive circuit, sampling of a video signal can be normally and more certainly started in each horizontal scanning period.

According to the third aspect of the present invention, in the source shift clock signal generating circuit, a pulse width of a source shift clock signal is made smaller based on a source shift clock modification command signal to be outputted from the source start pulse signal generating circuit. By this, a pulse width of the source shift clock signal can be easily made smaller only immediately before a source start pulse signal rises.

According to the fourth aspect of the present invention, the output of a pulse of a source shift clock signal is stopped during a period of time which is immediately before a pulse of a source start pulse signal is outputted. By this, a hold period that is not sufficiently secured in conventional cases is sufficiently secured immediately before the source start pulse signal rises. Hence, without increasing the frequency of a source clock signal or increasing circuit scale, in the video signal line drive circuit, sampling of a video signal can be normally started in each horizontal scanning period. By this, when there is a change in the design of a panel of a display, or the like, a further reduction in power consumption or further simplification of circuit design over conventional cases is made possible.

According to the fifth aspect of the present invention, in the source shift clock signal generating circuit, the output of a pulse of a source shift clock signal is stopped based on a source shift clock modification command signal to be outputted from the source start pulse signal generating circuit. By this, the output of a pulse of the source shift clock signal can be easily stopped only immediately before a source start pulse rises.

According to the sixth aspect of the present invention, when there is a change in the design of a panel, or the like, a display is implemented which is capable of achieving a further reduction in power consumption or further simplification of circuit design over conventional cases.

According to the ninth aspect of the present invention, in a display that uses a polysilicon liquid crystal panel, when there is a change in the design of the panel, or the like, a further reduction in power consumption or further simplification of circuit design over conventional cases is made possible.

According to the tenth aspect of the present invention, as with the sixth aspect of the present invention, when there is a change in the design of a panel, or the like, a display is implemented which is capable of achieving a further reduction in power consumption or further simplification of circuit design over conventional cases.

According to the twelfth aspect of the present invention, as with the ninth aspect of the present invention, in a display that uses a polysilicon liquid crystal panel, when there is a change in the design of the panel, or the like, a further reduction in power consumption or further simplification of circuit design over conventional cases is made possible.

DESCRIPTION OF THE REFERENCE NUMERALS

21: CONTROL CIRCUIT
22: DISPLAY DATA GENERATION CIRCUIT
23: TIMING CONTROL CIRCUIT
100: LIQUID CRYSTAL PANEL
200: DISPLAY CONTROL CIRCUIT
231: SOURCE DRIVER CONTROL CIRCUIT
300: SOURCE DRIVER
400: GATE DRIVER
500: DISPLAY UNIT
2311: SOURCE START PULSE SIGNAL GENERATING CIRCUIT
2312: SOURCE START PULSE SIGNAL DELAY CIRCUIT
2313: SOURCE SHIFT CLOCK SIGNAL GENERATING CIRCUIT
2314: SOURCE SHIFT CLOCK SIGNAL DELAY CIRCUIT
CK: SOURCE CLOCK SIGNAL
SCK: SOURCE SHIFT CLOCK SIGNAL
SSP: SOURCE START PULSE SIGNAL

BEST MODE FOR CARRYING OUT THE INVENTION

An embodiment of the present invention will be described below with reference to the accompanying drawings.

<1. Overall Configuration and Operation of a Liquid Crystal Display>

Figure 2:
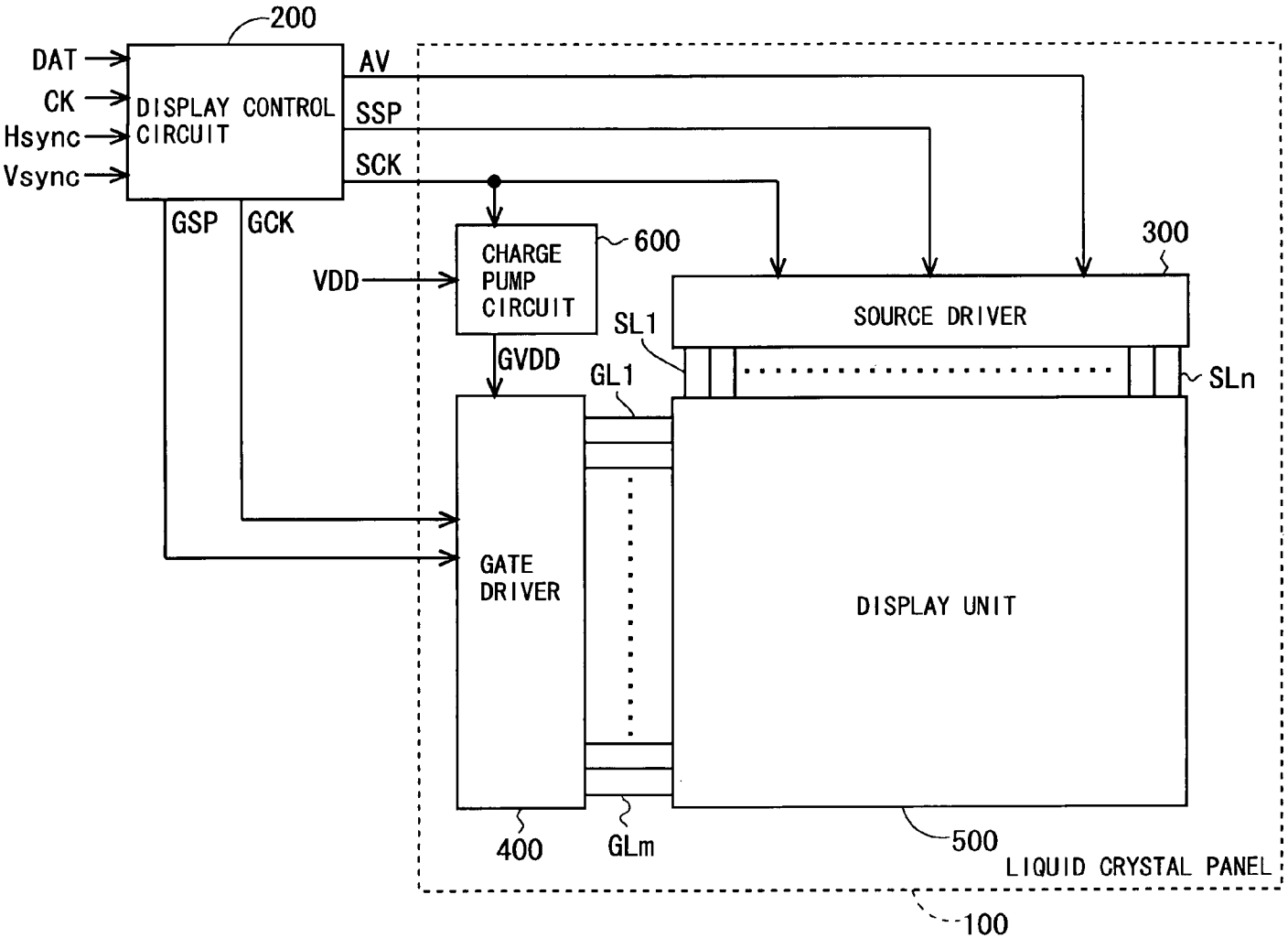
FIG. 2 is a block diagram showing the overall configuration of the CG silicon liquid crystal display according to the embodiment.

FIG. 2 is a block diagram showing the overall configuration of an active matrix-type liquid crystal display according to an embodiment of the present invention. The liquid crystal display has a liquid crystal panel 100 including a source driver (video signal line drive circuit) 300, a gate driver (scanning signal line drive circuit) 400, a display unit 500, and a charge pump circuit 600; and a display control circuit 200. The display unit 500 includes a plurality of (n) source bus lines (video signal lines) SL1 to SLn; a plurality of (m) gate bus lines (scanning signal lines) GL1 to GLm; and a plurality of (n×m) pixel formation portions respectively provided at intersections of the plurality of source bus lines SL1 to SLn and the plurality of gate bus lines GL1 to GLm. Each pixel formation portion includes a TFT serving as a switching element; a pixel electrode connected to a drain terminal of the TFT; a common electrode and an auxiliary capacitance electrode which are commonly provided for the plurality of pixel formation portions; a liquid crystal capacitance formed by the pixel electrode and the common electrode; and an auxiliary capacitance formed by the pixel electrode and the auxiliary capacitance electrode. Then, a pixel capacitance is formed by the liquid crystal capacitance and the auxiliary capacitance.

The display control circuit 200 receives an image signal DAT, a horizontal synchronizing signal Hsync, and a vertical synchronizing signal. Vsync which are provided from an external source and a source clock signal CK generated by a clock generator and outputs an analog video signal AV, and a source start pulse signal SSP, a source shift clock signal SCK, a gate start pulse signal GSP, and a gate shift clock signal GCK, for controlling timing to display an image on the display unit 500.

To the charge pump circuit 600 are provided a power supply voltage VDD and the source shift clock signal SCK which is outputted from the display control circuit 200. The charge pump circuit 600 boosts the power supply voltage VDD by the source shift clock signal SCK and thereby generates an output voltage GVDD. The output voltage GVDD is provided to the auxiliary capacitance electrode and the gate driver 400.

The source driver 300 receives the analog video signal AV, the source start pulse signal SSP, and the source shift clock signal SCK which are outputted from the display control circuit 200 and applies a driving video signal to each of the source bus lines SL1 to SLn to charge a pixel capacitance in each pixel formation portion in the display unit 500.

The gate driver 400 repeats an application of an active scanning signal to each of the gate bus lines GL1 to GLm with one vertical scanning period as a cycle, based on the gate start pulse signal GSP and the gate shift clock signal GCK which are outputted from the display control circuit 200 and the output voltage GVDD from the charge pump circuit 600.

In the above-described manner, a driving video signal is applied to each of the source bus lines SL1 to SLn and a scanning signal is applied to each of the gate bus lines GL1 to GLm, whereby an image is displayed on the display unit 500.

<2. Display Control Circuit>

Figure 1:
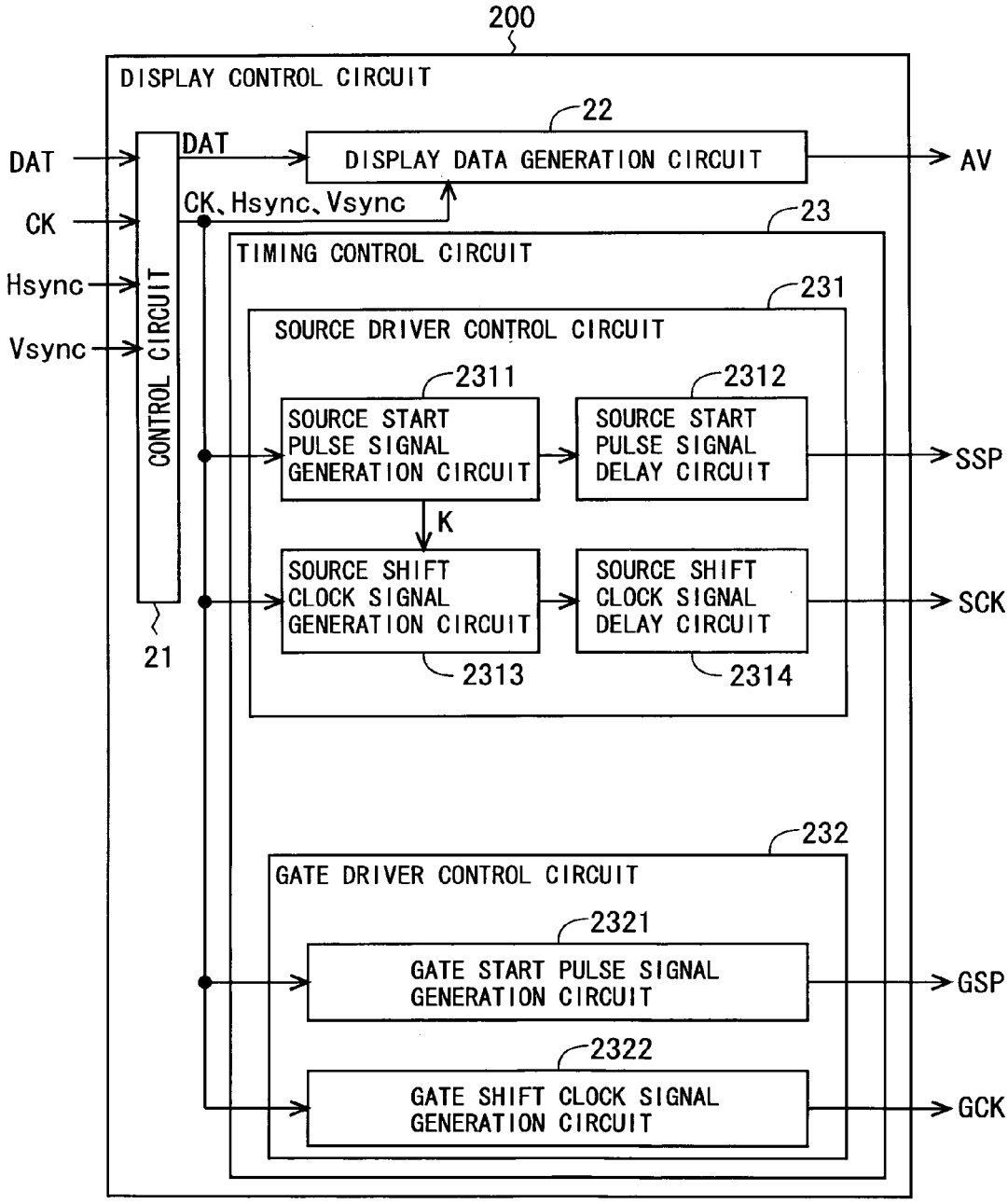
FIG. 1 is a block diagram showing a configuration of a display control circuit of a CG silicon liquid crystal display according to one embodiment of the present invention.

Next, the detailed configuration and operation of the display control circuit 200 in the present embodiment will be described. FIG. 1 is a block diagram showing a detailed configuration of the display control circuit 200 in the present embodiment. The display control circuit 200 has a control circuit 21, a display data generation circuit 22, and a timing control circuit 23. The timing control circuit 23 includes a source driver control circuit 231 and a gate driver control circuit 232. Furthermore, the source driver control circuit 231 includes a source start pulse signal generating circuit 2311, a source start pulse signal delay circuit 2312, a source shift clock signal generating circuit 2313, and a source shift clock signal delay circuit 2314. Furthermore, the gate driver control circuit 232 includes a gate start pulse signal generation circuit 2321 and a gate shift clock signal generation circuit 2322.

The control circuit 21 receives an image signal DAT, a horizontal synchronizing signal Hsync, a vertical synchronizing signal Vsync, and a source clock signal CK, which are sent from an external source, and provides the image signal DAT to the display data generation circuit 22 and provides the horizontal synchronizing signal Hsync, the vertical synchronizing signal Vsync, and the source clock signal CK to the display data generation circuit 22 and the timing control circuit 23, so that a desired image display is performed. The display data generation circuit 22 receives the image signal DAT, the horizontal synchronizing signal Hsync, the vertical synchronizing signal Vsync, and the source clock signal CK and outputs an analog video signal AV.

The source start pulse signal generating circuit 2311 receives the horizontal synchronizing signal Hsync and the source clock signal CK and generates a source start pulse signal SSP in which a pulse having a predetermined width is outputted every horizontal scanning period. The source start pulse signal generating circuit 2311 also provides a source shift clock modification command signal K to the source shift clock signal generating circuit 2313 to modify a waveform of a source shift clock signal SCK immediately before a pulse of the source start pulse signal SSP is outputted. The source start pulse signal delay circuit 2312 delays the source start pulse signal SSP generated by the source start pulse signal generating circuit 2311, for a predetermined period of time to adjust timing between the source start pulse signal SSP and the source shift clock signal SCK.

The source shift clock signal generating circuit 2313 receives the horizontal synchronizing signal Hsync and the source clock signal CK and generates a source shift clock signal SCK that is a clock signal of a cycle which is six times longer than a cycle T of the source clock signal CK and that has a duty ratio of 50 percent. Note that immediately before a pulse of the source start pulse signal SSP is outputted, a waveform of the source shift clock signal SCK is modified based on the source shift clock modification command signal K outputted from the source start pulse signal generating circuit 2311. The source shift clock signal delay circuit 2314 delays the source shift clock signal SCK generated by the source shift clock signal generating circuit 2313, for a predetermined period of time to adjust timing between the source start pulse signal SSP and the source shift clock signal SCK. Note that in the source shift clock signal generating circuit 2313, as described above, modification of the waveform of the source shift clock signal SCK is performed and the modification of the waveform is performed by a logic circuit using conventional art.

The gate start pulse signal generation circuit 2321 receives the horizontal synchronizing signal Hsync, the vertical synchronizing signal Vsync, and the source clock signal CK and generates a gate start pulse signal GSP in which a pulse having a predetermined width is outputted every vertical scanning period. The gate shift clock signal generation circuit 2322 receives the horizontal synchronizing signal Hsync, the vertical synchronizing signal Vsync, and the source clock signal CK and generates a gate shift clock signal GCK such that an active scanning signal is sequentially applied to each of the gate bus lines GL1 to GLm every horizontal scanning period.

<3. Drive Method>

Figure 3:
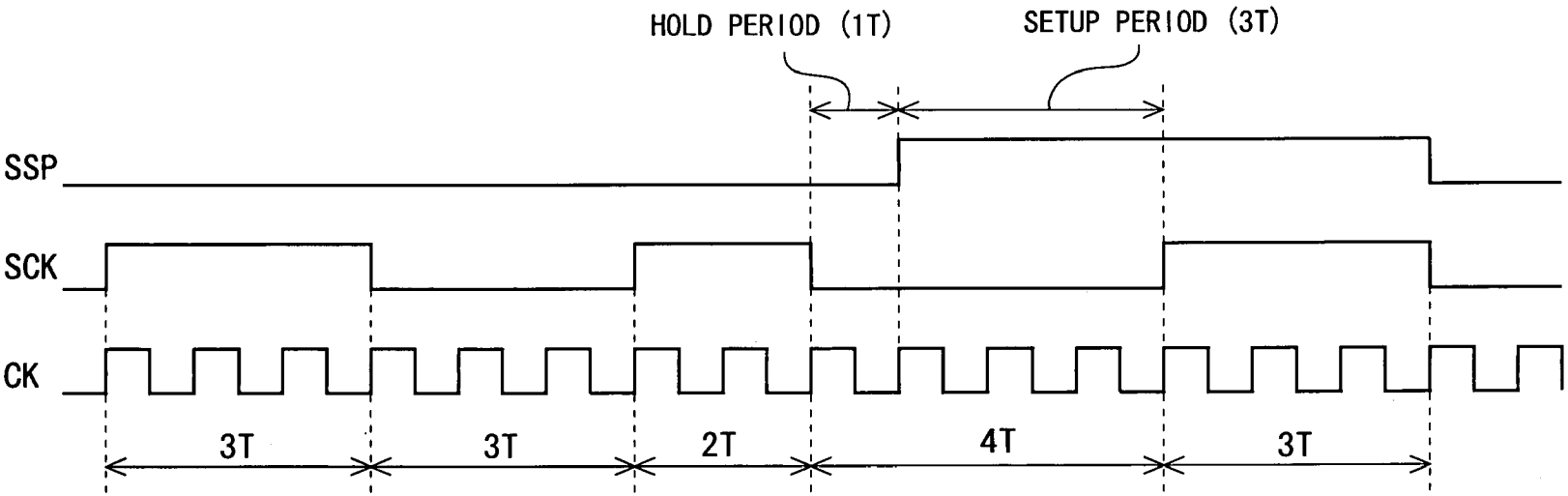
FIG. 3 is a signal waveform diagram in the embodiment.

Next, a drive method in the present embodiment will be described. FIG. 3 is a signal waveform diagram of the source start pulse signal SSP, the source shift clock signal SCK, and the source clock signal CK in the present embodiment. As shown in FIG. 3, description is made with the cycle of the source clock signal CK being T. In each horizontal scanning period, after the first rise of the source shift clock signal SCK after the source start pulse signal SSP rises, a period during which the source shift clock signal SCK is at a high level and a period during which the source shift clock signal SCK is at a low level alternately appear every 3 T. However, in each horizontal scanning period, for a period of time which is immediately before the source start pulse signal SSP rises, as shown in FIG. 3, a period during which the source shift clock signal SCK is at a high level is 2 T. On the other hand, a period during which the source shift clock signal SCK is at a low level and where the point in time when the source start pulse signal SSP changes from a low level to a high level gets in, is 4 T. As such, in the present embodiment, in each horizontal scanning period, a period during which the source shift clock signal SCK is at a high level is shortened only immediately before the source start pulse signal SSP rises.

By the waveform of the source shift clock signal SCK being modified in the above-described manner, as shown in FIG. 3, 1 T is secured for a hold period from when the source shift clock signal SCK falls until the source start pulse signal SSP rises. In addition, 3 T is secured for a setup period from when the source start pulse signal SSP rises until the source shift clock signal SCK rises.

<4. Effects>

As described above, according to the present embodiment, in the source shift clock signal generating circuit 2313 in the display control circuit 200, a source shift clock signal SCK is generated based on a source clock signal CK and a source shift clock modification command signal K which is provided from the source start pulse signal generating circuit 2311. Here, in each horizontal scanning period, a period during which the source shift clock signal SCK is maintained at a high level is shortened only immediately before a source start pulse signal SSP rises. On the other hand, a period during which the source shift clock signal SCK is maintained at a low level is lengthened by an amount corresponding to a period of time by which the period during which the source shift clock signal SCK is maintained at a high level is shortened. By this, a hold period is secured immediately before the source start pulse signal SSP rises and a setup period is secured immediately after the source start pulse signal SSP rises. Accordingly, in each horizontal scanning period, taking in of the source start pulse signal SSP in the source driver 300 is properly started and data sampling is properly performed.

Conventionally, in order to secure a hold period and a setup period, the frequency of a source clock CK is increased or both-edge drive of a clock is performed. Increasing the frequency of the source clock signal CK increases power consumption; however, in the present embodiment, the frequency of the source clock signal CK is not increased. Therefore, in the present embodiment, power consumption cannot be increased. When both-edge drive of a clock is performed, due to adoption of a two-phase clock, or the like, circuit scale increases, complicating design. On the other hand, in the present embodiment, there is no need to perform both-edge drive of a clock. Hence, in the present embodiment, circuit scale cannot be increased and design cannot be complicated. In addition, according to the present embodiment, panel design taking into account a process margin is made possible, and thus, the probability of occurrence of defectives in a manufacturing process is reduced, improving yields.

<5. Variant, Etc.>

Figure 4:
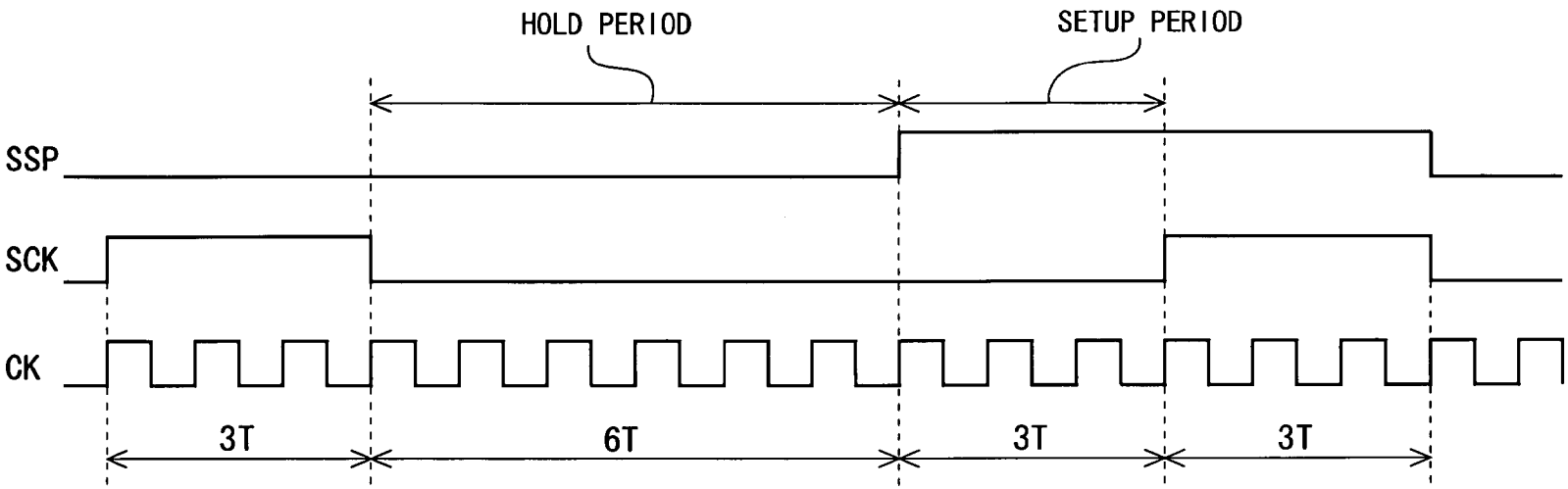
FIG. 4 is a signal waveform diagram in a variant of the embodiment.
Figure 5:
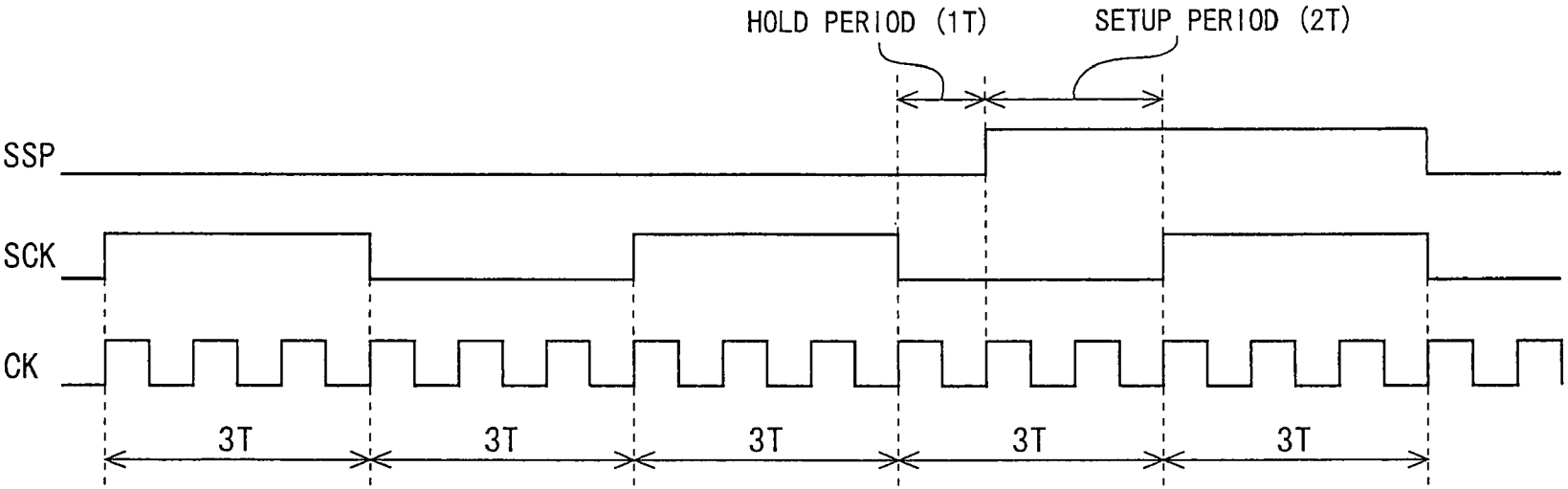
PRIOR ART Fig.5
FIG. 5 is a signal waveform diagram for a common liquid crystal display.
Figure 6:
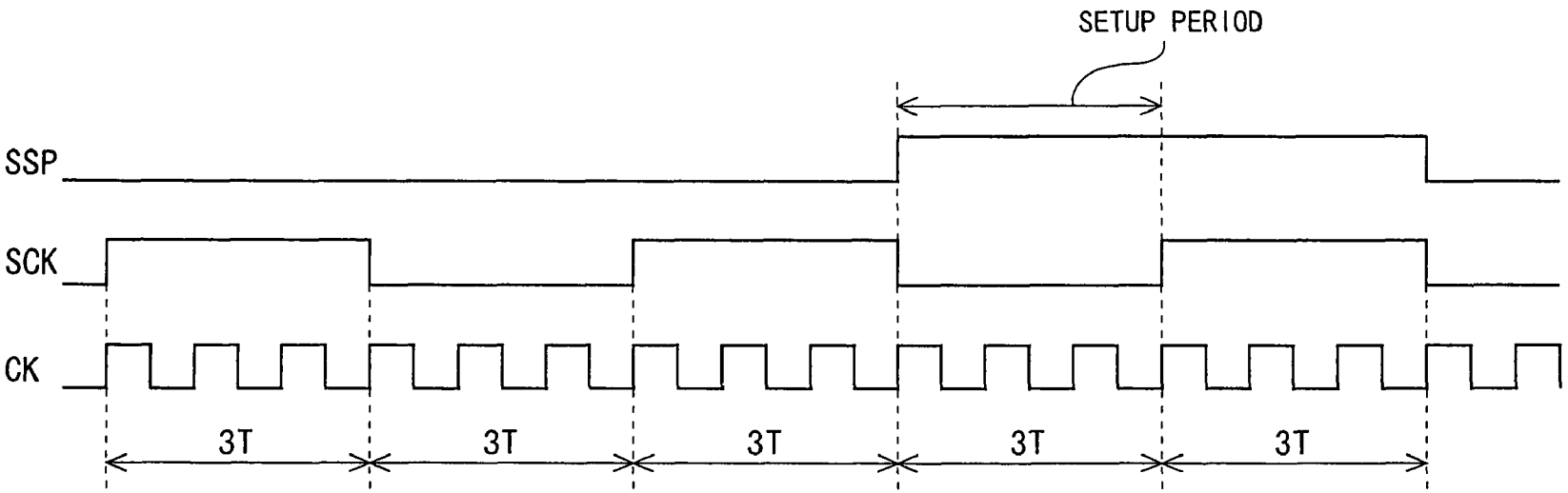
PRIOR ART Fig.6
FIG. 6 is a signal waveform diagram for a conventional CG silicon liquid crystal display.
Figure 7:
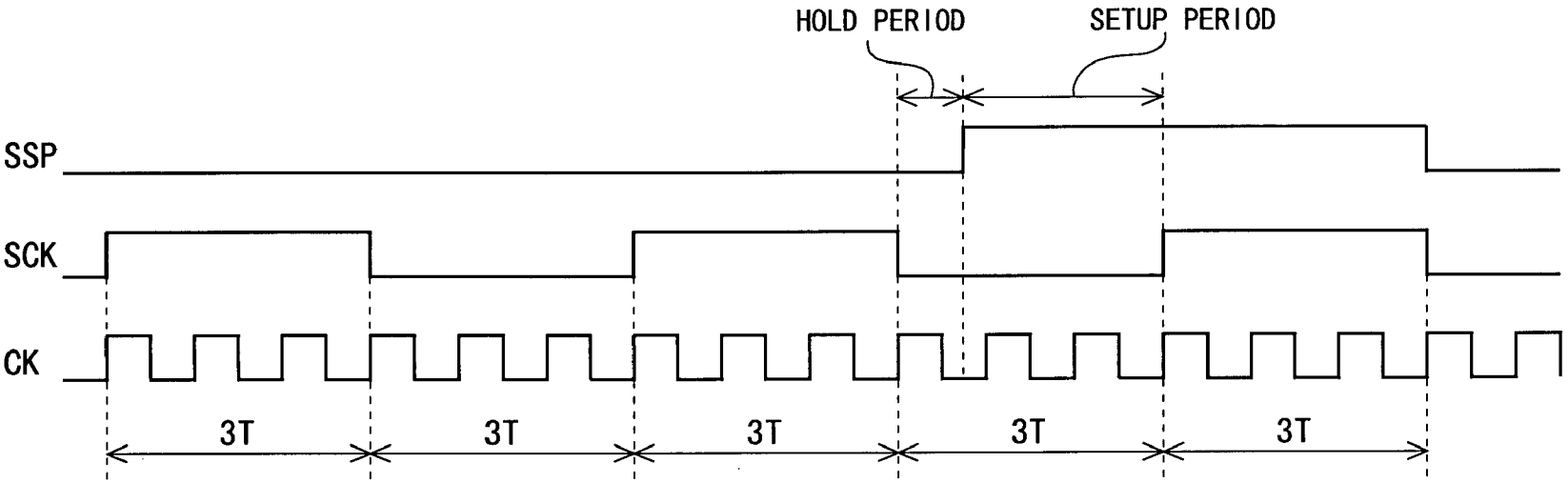
FIG. 7 is a signal waveform diagram for the case in which a hold period and a setup period are not an integral multiple of a cycle of a source clock signal.

Although, in the above-described embodiment, a hold period is secured by shortening a period during which a source shift clock signal SCK is at a high level immediately before a source start pulse signal SSP rises, the present invention is not limited thereto. As shown in FIG. 4, a hold period can also be secured by stopping the output of a pulse of a source shift clock signal SCK only immediately before a source start pulse signal SSP rises. Note that although FIG. 4 shows the case, as an example, in which one horizontal scanning period is an integral multiple of 3 T, one horizontal scanning period is not necessarily an integral multiple of 3 T and there is a possibility that a hold period varies in a range from 1 T to 6 T and thus the period may be longer than that. Although a horizontal synchronizing signal Hsync, a vertical synchronizing signal Vsync, and the like, are used as signals, a signal having the same functions, such as a composite synchronizing signal, can also be used and a source clock signal CK may be provided from an external source. Furthermore, although in the above-described embodiment the case is described in which a digital signal as an image signal DAT is inputted, the present invention can also be applied to the case in which an analog signal is to be inputted.

Although, as shown in the above-described embodiment, the present invention is suitable for a display that uses a polysilicon liquid crystal panel, such as a CG silicon liquid crystal display, the present invention can also be applied to other displays. Furthermore, the present invention can also be applied to both a digital driver and an analog driver and can also be applied to both a drive circuit that adopts a dot sequential drive scheme and a drive circuit that adopts a line sequential drive scheme.

Moreover, although, in the above-described embodiment, the description is made using an example in which a period during which the source shift clock signal SCK is at a high level and a period during which the source shift clock signal SCK is at a low level alternately appear every 3 T, the present invention is not limited thereto and the period during which the source shift clock signal SCK is at a high level and the period during which the source shift clock signal SCK is at a low level may be other than 3 T.

The invention claimed is:

1. A drive circuit for a display that applies a driving video signal to a plurality of video signal lines arranged in a display unit and thereby displays an image on the display unit, the drive circuit comprising:

a display control circuit that outputs a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line drive circuit that receives the video signal, the source start pulse signal, and the source shift clock signal which are outputted from the display control circuit, samples the video signal based on a pulse of the source shift clock signal after a pulse of the source start pulse signal is outputted in each horizontal scanning period, and applies a voltage based on the sampled video signal to the plurality of video signal lines as the driving video signal, wherein the display control circuit makes a width of a pulse of the source shift clock signal, which is outputted immediately before a pulse of the source start pulse signal is outputted, smaller than the first width.

2. The drive circuit according to claim 1, wherein the display control circuit makes the width of a pulse of the source shift clock signal, which is outputted immediately before a pulse of the source start pulse signal is outputted, smaller than the first width by changing a duty ratio of the source shift clock signal.

3. The drive circuit according to claim 1, wherein the display control circuit includes:

a source start pulse signal generating circuit that generates the source start pulse signal based on the source clock signal; and a source shift clock signal generating circuit that generates the source shift clock signal based on the source clock signal, wherein the source start pulse signal generating circuit generates a source shift clock modification command signal for making the width of a pulse of the source shift clock signal, which is outputted immediately before a pulse of the source start pulse signal is outputted, smaller than the first width, and provides the source shift clock modification command signal to the source shift clock signal generating circuit, and wherein the source shift clock signal generating circuit makes the width of a pulse of the source shift clock signal, which is outputted immediately before a pulse of the source start pulse signal is outputted, smaller than the first width based on the source shift clock modification command signal.

4. A drive circuit for a display that applies a driving video signal to a plurality of video signal lines arranged in a display unit and thereby displays an image on the display unit, the drive circuit comprising:

a display control circuit that outputs a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line drive circuit that receives the video signal, the source start pulse signal, and the source shift clock signal which are outputted from the display control circuit, samples the video signal based on a pulse of the source shift clock signal after a pulse of the source start pulse signal is outputted in each horizontal scanning period, and applies a voltage based on the sampled video signal to the plurality of video signal lines as the driving video signal, wherein the display control circuit stops an output of a pulse of the source shift clock signal to be outputted immediately before a pulse of the source start pulse signal is outputted.

5. The drive circuit according to claim 4, wherein the display control circuit includes:

a source start pulse signal generating circuit that generates the source start pulse signal based on the source clock signal; and a source shift clock signal generating circuit that generates the source shift clock signal based on the source clock signal, wherein the source start pulse signal generating circuit generates a source shift clock modification command signal for stopping the output of a pulse of the source shift clock signal to be outputted immediately before a pulse of the source start pulse signal is outputted, and provides the source shift clock modification command signal to the source shift clock signal generating circuit, and wherein the source shift clock signal generating circuit stops the output of a pulse of the source shift clock signal to be outputted immediately before a pulse of the source start pulse signal is outputted, based on the source shift clock modification command signal.

6. A display that applies a driving video signal to a plurality of video signal lines arranged in a display unit and thereby displays an image on the display unit, the display comprising:

a display control circuit that outputs a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line drive circuit that receives the video signal, the source start pulse signal, and the source shift clock signal which are outputted from the display control circuit, samples the video signal based on a pulse of the source shift clock signal after a pulse of the source start pulse signal is outputted in each horizontal scanning period, and applies a voltage based on the sampled video signal to the plurality of video signal lines as the driving video signal, wherein the display control circuit makes a width of a pulse of the source shift clock signal, which is outputted immediately before a pulse of the source start pulse signal is outputted, smaller than the first width.

7. The display according to claim 6, wherein the display control circuit makes the width of a pulse of the source shift clock signal, which is outputted immediately before a pulse of the source start pulse signal is outputted, smaller than the first width by changing a duty ratio of the source shift clock signal.

8. The display according to claim 6, wherein the display control circuit includes:

a source start pulse signal generating circuit that generates the source start pulse signal based on the source clock signal; and a source shift clock signal generating circuit that generates the source shift clock signal based on the source clock signal, wherein the source start pulse signal generating circuit generates a source shift clock modification command signal for making the width of a pulse of the source shift clock signal, which is outputted immediately before a pulse of the source start pulse signal is outputted, smaller than the first width, and provides the source shift clock modification command signal to the source shift clock signal generating circuit, and wherein the source shift clock signal generating circuit makes the width of a pulse of the source shift clock signal, which is outputted immediately before a pulse of the source start pulse signal is outputted, smaller than the first width based on the source shift clock modification command signal.

9. The display according to claim 6, wherein a drive circuit including at least the video signal line drive circuit is made of a polysilicon thin film transistor.

10. A display that applies a driving video signal to a plurality of video signal lines arranged in a display unit and thereby displays an image on the display unit, the display comprising:

a display control circuit that outputs a video signal for Generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line drive circuit that receives the video signal, the source start pulse signal, and the source shift clock signal which are outputted from the display control circuit, samples the video signal based on a pulse of the source shift clock signal after a pulse of the source start pulse signal is outputted in each horizontal scanning period, and applies a voltage based on the sampled video signal to the plurality of video signal lines as the driving video signal, wherein the display control circuit stops an output of a pulse of the source shift clock signal to be outputted immediately before a pulse of the source start pulse signal is outputted.

11. The display according to claim 10, wherein the display control circuit includes:

a source start pulse signal generating circuit that generates the source start pulse signal based on the source clock signal; and a source shift clock signal generating circuit that generates the source shift clock signal based on the source clock signal, wherein the source start pulse signal generating circuit generates a source shift clock modification command signal for stopping the output of a pulse of the source shift clock signal to be outputted immediately before a pulse of the source start pulse signal is outputted, and provides the source shift clock modification command signal to the source shift clock signal generating circuit, and wherein the source shift clock signal generating circuit stops the output of a pulse of the source shift clock signal to be outputted immediately before a pulse of the source start pulse signal is outputted, based on the source shift clock modification command signal.

12. The display according to claim 10, wherein a drive circuit including at least the video signal line drive circuit is made of a polysilicon thin film transistor.

13. A drive method for a display that applies a driving video signal to a plurality of video signal lines arranged in a display unit and thereby displays an image on the display unit, the drive method comprising the steps of:

a display controlling step of outputting a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line driving step of receiving the video signal, the source start pulse signal, and the source shift clock signal which are outputted in the display controlling step, sampling the video signal based on a pulse of the source shift clock signal after a pulse of the source start pulse signal is outputted in each horizontal scanning period, and applying a voltage based on the sampled video signal to the plurality of video signal lines as the driving video signal, wherein in the display controlling step, a width of a pulse of the source shift clock signal, which is outputted immediately before a pulse of the source start pulse signal is outputted, is made smaller than the first width.

14. The drive method according to claim 13, wherein in the display controlling step, the width of a pulse of the source shift clock signal, which is outputted immediately before a pulse of the source start pulse signal is outputted, is made smaller than the first width by changing a duty ratio of the source shift clock signal.

15. A drive method for a display that applies a driving video signal to a plurality of video signal lines arranged in a display unit and thereby displays an image on the display unit, the drive method comprising the steps of:

a display controlling step of outputting a video signal for generating the driving video signal, a source start pulse signal in which a pulse appears every horizontal scanning period, and a source shift clock signal which is a clock signal and in which a pulse having a first width repeatedly appears every horizontal scanning period, based on a source clock signal in which a pulse having a predetermined width repeatedly appears and an image signal to be provided from an external source; and a video signal line driving step of receiving the video signal, the source start pulse signal, and the source shift clock signal which are outputted in the display controlling step, sampling the video signal based on a pulse of the source shift clock signal after a pulse of the source start pulse signal is outputted in each horizontal scanning period, and applying a voltage based on the sampled video signal to the plurality of video signal lines as the driving video signal, wherein in the display controlling step, an output of a pulse of the source shift clock signal to be outputted immediately before a pulse of the source start pulse signal is outputted is stopped.

* * * * *